United States Patent [19]

Joseph

[11] 4,209,584

[45] Jun. 24, 1980

[54] MANUFACTURE OF PHOTOGRAPHIC ELEMENTS HAVING ANTICURL AND ANTISTATIC LAYERS

[75] Inventor: Douglas C. Joseph, Victor, N.Y.

[73] Assignee: Eastman Kodak Company, Rochester, N.Y.

[21] Appl. No.: 49,002

[22] Filed: Jun. 15, 1979

[51] Int. Cl.[2] ..... G03C 1/78; G03C 1/84

[52] U.S. Cl. ..... 430/527; 430/538; 430/531; 430/930

[58] Field of Search ..... 96/85, 87 R, 87 A, 67, 96/33; 427/438

[56] References Cited

U.S. PATENT DOCUMENTS

| | | | |
|---|---|---|---|
| 2,649,374 | 9/1953 | Richardson | 96/87 A |
| 2,993,793 | 7/1961 | Beersman et al. | 96/87 A |
| 3,033,679 | 5/1962 | Laakso et al. | 96/87 A |
| 3,437,484 | 4/1969 | Nadeau | 96/87 A |
| 3,525,621 | 8/1970 | Miller | 96/85 |
| 3,630,740 | 12/1971 | Joseph | 96/85 |
| 3,630,742 | 12/1971 | Crawford et al. | 96/87 R |
| 3,655,386 | 4/1972 | Wood | 96/87 A |
| 3,681,070 | 8/1972 | Temmerman et al. | 96/1.5 |
| 4,001,024 | 1/1977 | Dittman et al. | 96/85 |
| 4,113,905 | 9/1978 | Choing et al. | 96/85 |

*Primary Examiner*—Jack P. Brammer

*Attorney, Agent, or Firm*—A. P. Lorenzo

[57] ABSTRACT

Photographic elements comprised of a support coated on one side with at least one image-forming layer, and on the opposite side with separate anticurl and antistatic layers in contiguous relationship, are prepared by a method in which the anticurl and antistatic layers are coated on the support by a tandem gravure coating process. In carrying out such process, the anticurl layer is formed by gravure coating of an anticurl coating composition comprising a hydrophilic colloid and the antistatic layer is formed by gravure coating of an antistatic coating composition comprising an antistatic agent and a diffusible hardening agent, which acts as a hardener for hydrophilic colloids and is present in the antistatic coating composition in an amount sufficient to diffuse from the antistatic layer to the anticurl layer.

32 Claims, 2 Drawing Figures

MANUFACTURE OF PHOTOGRAPHIC ELEMENTS HAVING ANTICURL AND ANTISTATIC LAYERS

BACKGROUND OF THE INVENTION

1. Field of the Invention

This invention relates in general to photography and in particular to the manufacture of photographic elements. More specifically, this invention relates to the manufacture of photograhic elements comprised of a support coated on one side with at least one imageforming layer and on the opposite side with separate anticurl and antistatic layers.

2. Description of the Prior Art

Photographic elements typically comprise a support material, such as paper, a polymeric film or polymer-coated paper, having on one side thereof one or more image-forming layers; for example, radiation-sensitive layers comprising a radiation-sensitive agent dispersed in a hydrophilic colloid or an imagereceiving layer comprising a nucleating agent dispersed in a hydrophilic colloid. In a particularly common type of photographic element, the radiation-sensitive agent is a silver halide and the hydrophilic colloid in which it is dispersed is gelatin. Under typical conditions of manufacture and use, photographic elements have a tendency during drying thereof to undergo curling toward the image-forming layer(s). This is a result of the tendency of gelatin and other hydrophilic colloids to shrink on drying, with the resulting creation of tensions within the dried layer(s). To eliminate or reduce the undesirable curling propensity of photographic elements, it is common practice to provide an anticurl layer on the side of the support opposite to the image-forming layer(s). The anticurl layer contains a hydrophilic colloid which shrinks on drying and thereby creates tensions which counteract and balance those produced in the image-forming layer(s). In addition to the hydrophilic colloid, it typically contains a hardening agent, which functions to form a hardened layer that resists removal during photographic processing, and may also contain other materials such as particulate fillers of either organic or inorganic type. Anticurl layers are described, for example, in U.S. Pat. Nos. 2,993,793 and 3,630,742.

In addition to anticurl protection, it is often necessary to provide photographic elements with antistatic protection. The accumulation of static electrical charges on photographic elements is a very serious problem in the photographic art. These charges arise from a variety of factors during the manufacture, handling and use of photographic elements. For example, they can occur on sensitizing equipment and on slitting and spooling equipment, and can arise when the paper or film is unwound from a roll or as a result of contact with transport rollers. The generation of static is affected by the conductivity and moisture content of the photographic material and by the atmospheric conditions under which the material is handled. The degree to which protection against the adverse effects of static is needed is dependent on the nature of the particular photographic element. Thus, elements utilizing high speed emulsions have a particularly acute need for antistatic protection. Accumulation of static charges can cause irregular fog patterns in a photographic emulsion layer, and this is an especially severe problem with high speed emulsions. Static charges are also undesirable because they attract dirt to the photographic element and this can cause repellency spots, desensitization, fog and physical defects.

To overcome the adverse effects resulting from accumulation of static electrical charges, it is conventional practice to include an antistatic layer in photographic elements. Typically, such antistatic layer are composed of materials which dissipate the electrical charge by providing a conducting surface. A very wide variety of antistatic agents are known for use in antistatic layers of photographic elements. For example, U.S. Pat. No. 2,649,374 describes a photographic film comprising an antistatic layer in which the antistatic agent is the sodium salt of a condensation product of formaldehyde and naphthalene sulfonic acid. An antistatic layer comprising an alkali metal salt of a copolymer of styrene and styrylundecanoic acid is disclosed in U.S. Pat. No. 3,033,679. Photographic films having an antistatic layer containing a metal halide, such as sodium chloride or potassium chloride, as the conducting material, a polyvinyl alcohol binder, a hardener, and a matting agent are described in U.S. Pat. No. 3,437,484. In U.S. Pat. No. 3,525,621, the antistatic layer is comprised of colloidal silica and an organic antistatic agent, such as an alkali metal salt of an alkylaryl polyether sulfonate, an alkali metal salt of an arylsulfonic acid, or an alkali metal salt of a polymeric carboxylic acid. Use in an antistatic layer of a combination of an anionic filmforming polyelectrolyte, colloidal silica and a polyalkylene oxide is disclosed in U.S. Pat. No. 3,630,740. In U.S. Pat. No. 3,655,386, the surface conductivity of photographic film is improved by coating it with an aqueous alcohol solution of sodium cellulose sulfate. In U.S. Pat. No. 3,681,070, an antistatic layer is described in which the antistatic agent is a copolymer of styrene and styrene sulfonic acid.

It is known to utilize a single layer which provides both anticurl and antistatic protection to a photographic element. It is also known to use separate anticurl and antistatic layers positioned in contiguous relationship on the support. Use of a single layer which serves both purposes frequently results in a situation in which the layer is not ideal for either purpose. This is because the hydrophilic colloid which is needed to provide curl control is an electrical insulator which adversely affects the electrical conductivity which is needed for antistatic protection, and because the conductive agent which is required for antistatic protection adversely affects the ability of the hydrophilic colloid to counteract and balance the tensions which cause curling. Thus, a coating composition which is optimum for antistatic protection will usually be inferior as regards anticurl protection, and vice versa. This problem is mentioned in U.S. Pat. No. 3,630,742, which points out that use of a single layer of gelatin containing an antistatic agent to provide both anticurl and antistatic protection suffers from serious disadvantages, in that coaction typically occurs between the gelatin and the antistatic agent, with the result that an excessive amount of gelatin is required to reduce curl. As explained in this patent, substantially less gelatin is required to give the desired result when separate anticurl and antistatic layers are provided.

Separate anticurl and antistatic layers can be applied to a photographic element by a simultaneous dual-layer coating procedure; a method which is recommended in U.S. Pat. No. 3,630,742. Equipment and procedures for carrying out such simultaneous coating are well known and are described, for example, in U.S. Pat. Nos. 2,761,417, 2,761,418, 2,761,419, 2,761,791, and 3,508,947. However, in carrying out simultaneous dual-layer coating of anticurl and antistatic layers, a certain degree of inter-layer mixing is generally unavoidable because of the characteristics of the coating compositions. As a result of such inter-layer mixing, excessive amounts of the antistatic agent are needed to achieve the desired low surface resistivity. Since antistatic agents are generally quite costly, the need for high concentrations of antistatic agent is a major disadvantage which seriously hampers the commercial utilization of the process.

The present invention is directed toward the objective of providing a method for the manufacture of a photographic element, provided with separate anticurl and antistatic layers, which is simple to carry out, fast, inexpensive, and capable of making efficient use of both the gelatin, or other hydrophilic colloid, and the antistatic agent, so that both of these materials can be employed at an optimum level.

SUMMARY OF THE INVENTION

In accordance with this invention, a photograhic element, comprised of a support coated on one side with at least one image-forming layer and on the opposite side with separate anticurl and antistatic layers in contiguous relationship, is prepared by a method in which the anticurl and antistatic layers are coated on the support by a tandem gravure coating process. In carrying out such process, the anticurl layer is formed by gravure coating of an anticurl coating composition comprising a hydrophilic colloid and the antistatic layer is formed by gravure coating of an antistatic coating composition comprising an antistatic agent, and a diffusible hardening agent, hich acts as a hardener for hydrophilic colloids and is present in the antistatic coating composition in an amount sufficient to diffuse from the antistatic layer to the anticurl layer.

In one embodiment of the invention, the anticurl layer is applied prior to application of the antistatic layer i.e., the antistatic layer overlies the anticurl layer; while in an alternative embodiment the antistatic layer is applied prior to application of the anticurl layer, i.e., the anticurl layer overlies the antistatic layer. In either instance, at least a part of the hardening agent required to harden the hydrophilic colloid of the anticurl layer is provided by diffusion from the antistatic layer. In that embodiment in which the antistatic layer is applied prior to the anticurl layer, part of the hardening agent can be incorporated in the anticurl coating composition and part can be provided by diffusion from the antistatic layer, or all of the hardening agent can be provided by diffusion from the antistatic layer. In that embodiment in which the anticurl layer is applied prior to the antistatic layer, a hardening agent is incorporated in the anticurl coating composition, but it is utilized in an amount insufficient to effectively harden the hydrophilic colloid present therein and diffusion of hardening agent from the antistatic layer to the anticurl layer completes the hardening of the hydrophilic colloid present in the anticurl layer. By use of the method of this invention, both interlaying mixing and coaction between the hydrophilic colloid and the antistatic agent are avoided, so that both anticurl and antistatic protection are provided to the photographic element with the use of minimal amounts of hydrophilic colloid and antistatic agent.

DESCRIPTION OF THE PREFERRED EMBODIMENTS

Figure 2:
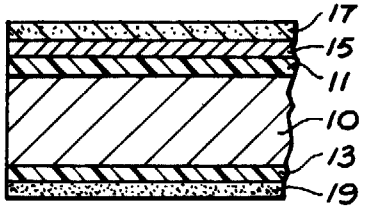
FIG. 2 is a partial cross-section taken substantially along the line 2—2 in FIG. 1.

As indicated hereinabove, the method of this invention involves gravure coating and, in particular, tandem gravure coating. Gravure coating is a well known coating procedure that utilizes a cylinder having a groove or dot pattern which has been etched or engraved on the surface thereof. The cylinder is rotated while partially immersed in a liquid coating composition and, as a result, the grooves or dots are filled with the coating composition. As the cylinder contacts a web of the support material to be coated, the coating composition is transferred from the grooves or dots to the web in a manner providing a highly uniform coating. By the term "a tandem gravure coating process," as used herein, is meant a method of coating in which a layer of a first coating composition is applied to a support by a gravure coating procedure and a layer of a second coating composition is applied, over the layer formed from the first coating composition, by a gravure coating procedure, with the two layers being applied by successive "in-line" coating operations.

Detailed information with respect to gravure coating is provided in Chapter 14 of the textbook "Coating Equipment and Processes" by George L. Booth, Lockwood Publishing Co., Inc., 551 Fifth Ave., New York, N.Y. 10017 (1970); the disclosure of which is incorporated herein by reference.

Photographic elements which are capable of manufacture by the method of this invention can differ greatly in structure and composition. For example, they can vary greatly in regard to the type of support, the number and composition of the image-forming layers, the kinds of auxiliary layers that are present, the particular materials from which the anticurl and antistatic layers are formed, and so forth.

Photographic elements which can be effectively protected against curling and the accumulation of static charges with the anticurl and antistatic layers described herein include elements prepared from any of a wide variety of photographic support materials. Typical photographic supports include polymeric film, wood fiber—e.g., paper, metallic sheet and foil, glass and ceramic supporting elements, and the like.

Typical of useful polymeric film supports are films of cellulose nitrate and cellulose esters such as cellulose triacetate and diacetate, polystyrene, polyamides, homo- and co-polymers of vinyl chloride, poly(vinylacetal), polycarbonate, homo- and co-polymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an α-olefin containing 2 to 10 carbon atoms in the repeating unit, such as polyethylene, polypropylene, copolymers of ethylene and propylene and the like.

Polyolefins, such as polyethylene, polypropylene and polyallomers—e.g., copolymers of ethylene with propylene, as illustrated by Hagemeyer et al U.S. Pat. No. 3,478,128, are preferably employed as resin coatings over paper, as illustrated by Crawford et al. U.S. Pat. No. 3,411,908 and Joseph et al U.S. Pat. No. 3,630,740, over polystyrene and polyester film supports, as illustrated by Crawford et al U.S. Pat. No. 3,630,742, or can be employed as unitary flexible reflection supports, as illustrated by Venor et al U.S. Pat. No. 3,973,963.

Preferred cellulose ester supports are cellulose triacetate supports, as illustrated by Fordyce et al U.S. Pat. Nos. 2,492,977, 2,492,978 and 2,739,069, as well as mixed cellulose ester supports, such as cellulose acetate propionate and cellulose acetate butyrate, as illustrated by Fordyce et al U.S. Pat. No. 2,739,070.

Preferred polyester film supports are comprised of linear polyester, such as illustrated by Alles et al U.S. Pat. No. 2,627,088, Wellman U.S. Pat. No. 2,720,503, Alles U.S. Pat. No. 2,779,684 and Kibler et al U.S. Pat. No. 2,901,466. Polyester films can be formed by varied techniques, as illustrated by Alles, cited above, Czerkas et al U.S. Pat. No. 3,663,683 and Williams et al U.S. Pat. No. 3,504,075, and modified for use as photographic film supports, as illustrated by Van Stappen U.S. Pat. No. 3,227,576, Nadeau et al U.S. Pat. No. 3,501,301, Reedy et al U.S. Pat. No. 3,589,905, Babbitt et al U.S. Pat. No. 3,850,640, Bailey et al U.S. Pat. No. 3,888,678, Hunter U.S. Pat. No. 3,904,420 and Mallinson et al U.S. Pat. No. 3,928,697.

The photograhic elements can employ supports which are resistant to dimensional change at elevated temperatures. Such supports can be comprised of linear condensation polymers which have glass transition temperatures above about 190° C., preferably 220° C., such as polycarbonates, polycarboxylic esters, polyamides polysulfonamides, polyethers, polyimides, polysulfonates and copolymer variants, as illustrated by Hamb U.S. Pat. Nos. 3,634,089 and 3,772,405; Hamb et al U.S. Pat. Nos. 3,725,070 and 3,793,249; Wilson *Research Disclosure*, Vol. 118, February 1974, Item 11833, and Vol. 120, April 1974, Item 12046; Conklin et al *Research Disclosure*, Vol. 120, April 1974, Item 12012; *Product Licensing Index*, Vol. 92, December 1971, Items 9205 and 9207; *Research Disclosure*, Vol. 101, September 1972, Items 10119 and 10148; *Research Disclosure*, Vol. 106 February 1973, Item 10613; *Research Disclosure*, Vol. 117, January 1974, Item 11709, and *Research Disclosure*, Vol. 134, June 1975, Item 13455.

The method of this invention is usefully employed in the manufacture of photographic elements intended for use in black-and-white photography and in the manufacture of photographic elements intended for use in color photography. In addition to the anticurl layer, the antistatic layer and one or more imageforming layers, the photographic elements can include subbing layers, protective overcoat layers, filter layers, antihalation layers, and so forth. The radiationsensitive image-forming layers, e.g., photographic emulsion layers, present in the photographic elements can contain any of the conventional silver halides as the radiationsensitive material, for example, silver chloride, silver bromide, silver bromoiodide, silver chlorobromide, silver chloroiodide, silver chlorobromoiodide, and mixtures thereof. Typically, these layers also contain a hydrophilic colloid. Illustrative examples of such colloids include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like as described in Yutzy et al U.S. Pat. Nos. 2,614,928 and 2,614,929, Lowe et al U.S. Pat. Nos. 2,691,582, 2,614,930, 2,614,931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312, and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, U.K. Pat No. 1,489,080 and Hori et al Belgian Pat No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Photographic emulsion layers and other layers of photographic elements such as overcoat layers, interlayers and subbing layers, as well as receiving layers in image transfer elements, can also contain alone or in combination with hydrophilic water permeable colloids as vehicles or vehicle extenders (e.g., in the form of lattices) synthetic polyermic peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564, and 3,813,251, Lowe U.S. Pat. Nos. 2,253,078, 2,276,322, 2,276,323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. Nos. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S.

Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and 808,228, Wood U.K. Pat. No. 822,192 and Iguchi et al U.K. Pat. No. 1,398,055.

Conventional addenda such as antifoggants, stabilizers, sensitizers, development modifiers, developing agents, hardeners, plasticizers, coating aids, and so forth, can be included in the photographic emulsion layers or other layers of the elements of this invention. The photographic elements protected with the anticurl and antistatic layers described herein can be films or papers sensitized with a black-and-white emulsion, elements designed for reversal color processing, negative color elements, image-receiver sheets, color print materials, and the like.

The anticurl coating composition utilized in the method of this invention comprises a hydrophilic colloid which is hardened by a hardening agent that is provided, at least in part, by diffusion from the antistatic layer to the anticurl layer. In certain embodiments of the invention, all of the hardening agent needed to harden the hydrophilic colloid of the anticurl layer is provided by diffusion from the antistatic layer, while in other embodiments part of the hardening agent is provided by diffusion and part is incorporated in the anticurl coating composition. Useful hydrophiic colloids include all of the colloids referred to hereinabove as being useful in radiation-sensitive photographic emulsion layers. Most typically, however, the hydrophilic colloid used in the anticurl coating composition is gelatin.

Hardening agents for hydrophilic colloids can be used individually or in combination and in free or in blocked form. A great many useful hardeners are known, including formaldehyde and free dialdehydes, such as succinaldehyde and glutaraldehyde, as illustrated by Allen et al U.S. Pat. No. 3,232,764; blocked dialdehydes, as illustrated by Kaszuba U.S. Pat. No. 2,586,168, Jeffreys U.S. Pat. No. 2,870,013, and Yamamoto et al. U.S. Pat. No. 3,819,608; α-diketones, as illustrated by Allen et al U.S. Pat. No. 2,725,305; active esters of the type described by Burness et al U.S. Pat. No. 3,542,558, sulfonate esters, as illustrated by Allen et al U.S. Pat. Nos. 2,725,305 and 2,726,162; active halogen compounds, as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861; s-triazines and diazines, as illustrated by Yamamoto et al U.S. Pat. No. 3,325,287, Anderau et al U.S. Pat. No. 3,288,775 and Stauner et al U.S. Pat. No. 3,992,366; epoxides, as illustrated by Allen et al U.S. Pat. No. 3,047,394, Burness U.S. Pat. No. 3,189,459 and Birr et al German Pat. No. 1,085,663; aziridines, as illustrated by Allen et al U.S. Pat. No. 2,950,197, Burness et al U.S. Pat. No. 3,271,175 and Sato et al U.S. Pat. No. 3,575,705; active olefins having two or more active bonds, as illustrated by Burness et al U.S. Pat. Nos. 3,490,911, 3,539,644 and 3,841,872 (U.S. Pat. No. Re. 29,305), Cohen U.S. Pat. No. 3,640,720, Kleist et al German Pat. 872,153 and Allen U.S. Pat. No. 2,992,109; blocked active olefins, as illustrated by Burness et al U.S. Pat. No. 3,360,372 and Wilson U.S. Pat. No. 3,345,177; carbodiimides, as illustrated by Blout et al German Pat. No. 1,148,446; isoxazolium salts unsubstituted in the 3-position, as illustrated by Burness et al U.S. Pat. No. 3,321,313; esters of 2-alkoxy-N-carboxydihydroquinoline, as illustrated by Bergthaller et al U.S. Pat. No. 4,013,468; N-carbamoyl and N-carbamoylopyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,419, 'onium substituted acroleins, as illustrated by Tschopp et al U.S. Pat. No. 3,792,021, and vinyl sulfones containing other hardening functional groups, as illustrated by Sera et al U.S. Pat. No. 4,028,320; and polymeric hardeners, such as dialdehyde starches, as illustrated by Jeffreys et al U.S. Pat. No. 3,057,723, and copoly(acrolein-methacrylic acid), as illustrated by Himmelmann et al U.S. Pat. No. 3,396,029.

The use of hardeners in combination is illustrated by Sieg et al U.S. Pat. No. 3,497,358, Dallon et al U.S. Pat. No. 3,832,181 and 3,840,370 and Yamamoto et al U.S. Pat. No. 3,898,089. Hardening accelerators can be used, as illustrated by Sheppard et al U.S. Pat. No. 2,165,421, Kleist German Pat. No. 881,444, Riebel et al U.S. Pat. No. 3,628,961 and Ugi et al U.S. Pat. No. 3,901,708.

The anticurl coating composition utilized in the method of this invention can contain an inert particulate filler material which serves to advantageously modify the characteristics of the anticurl layer; for example, silica, titanium dioxide, starch, calcium carbonate, ureaformaldehyde resins, and the like. Preferably, the particulate material is of very small particle size, such as a particle size in the range from about one to about ten microns.

In the method of this invention, the anticurl coating composition is applied by gravure coating. This is a method of coating which is essentially a low wet-laydown, high solids, rapid drying method. Among the most critical aspects of gravure coating is the need to properly formulate the coating composition for proper control of coating patterns. This requires a careful choice of coating aids such as leveling agents, surface tension control agents, and viscosity control agents. It is particularly advantageous to incorporate an alcohol in the anticurl coating composition to reduce surface tension and improve leveling, thereby preventing the formation of undesirable coating patterns and roughness. The alcohol is advantageously utilized in the coating composition in amounts of about 5 to about 15 percent by weight. Isobutanol is particularly effective for this purpose. In aqueous gelatin compositions, isobutanol eliminates foam by virtue of the portion which is insoluble in water, while the portion which is soluble reduces surface tension and improves leveling. Normal butanol is also effective and can generally be utilized at a somewhat lower level than isobutanol. In using an alcohol for this purpose, it is also important to properly adjust the viscosity of the coating composition, since if viscosity is not properly controlled, the alcohol can be rendered ineffective. Too low a viscosity, for the particular cell depth of the gravure cylinder utilized, results in "film-splitting" patterns, whereas too high a viscosity will hinder cell filling, and thereby result in erratic coverages.

The antistatic coating composition utilized in the method of this invention comprises, as essential components, an antistatic agent and a diffusible hardening agent that is capable of diffusing into the anticurl layer and acting as a hardener for the hydrophilic colloid of the anticurl layer. It can also contain a variety of optional components which serve to advantageously modify its characteristics.

It is an important feature of the present invention that the hardening agent that serves to harden the hydrophilic colloid of the anticurl layer is provided, at least in part, by diffusion from the antistatic layer to the anticurl layer. In a preferred embodiment of the invention, the anticurl coating composition is applied prior to the antistatic coating composition, that is, the anticurl layer is the lower layer and the antistatic layer is the upper layer. In this embodiment, the hardening agent is provided in part by incorporation in the anticurl coating composition and in part by diffusion from the antistatic layer. This is achieved by including the hardening agent in the anticurl coating composition in an amount insufficient to effectively harden the hydrophilic colloid present therein and by including the hardening agent in the antistatic coating composition in an amount sufficient to diffuse from the antistatic layer into the anticurl layer, so as to complete the hardening of the hydrophilic colloid present in the anticurl layer. Any of the hardening agents described hereinabove which are of the diffusible type can be utilized in the antistatic coating composition. The same or different hardening agents can be used in the anticurl and antistatic coating compositions, as desired. It is, of course, not necessary that the hardening agent used in the anticurl coating composition be capable of diffusing.

In the preferred embodiment of the invention described above, it is important to distribute the hardening agent in the manner described since satisfactory results are not achieved, in this embodiment, if all of the hardening agent is incorporated in the anticurl coating composition, nor if all of the hardening agent is incorporated in the antistatic coating composition. In particular, if the hardening agent is incorporated in the anticurl coating composition in an amount sufficient to effectively harden the hydrophilic colloid present therein, the coating composition will develop pituitousness and, as a result, can pull from the gravure cells in filaments. This defect is referred to in the gravure coating art as "angel hair." It, of course, renders it impossible to achieve the desired smooth uniform coating. On the other hand, if all of the hardening agent needed to effectively harden the hydrophilic colloid of the anticurl layer is included in the antistatic coating composition and none is incorporated in the anticurl coating composition, results would also be unsatisfactory, since coating of a layer of antistatic coating composition in a tandem gravure process over a dried layer of anticurl coating composition that contains no hardening agent will typically cause the anticurl layer to at least partially redissolve, and thereby result in severe interlayer mixing. By the method of this invention, involving the aforesaid distribution of the hardening agent, these problems are overcome and tandem gravure coating of the anticurl and antistatic layers of the photographic element is rendered feasible.

In the context of the present invention, the total amount of hardening agent that it is desired to provide to the anticurl layer to harden the hydrophilic colloid therein is referred to as "an amount sufficient to effectively harden the hydrophilic colloid." This amount is, of course, a matter of choice depending on the desired properties of the hardened anticurl layer, e.g. the degree of hardness desired.

The importance of proper distribution of the hardening agent is illustrated by the following example. In using, as the anticurl coating composition, an aqueous gelatin solution containing formaldehyde as hardening agent, it is necessary to utilize about 1% by weight of formaldehyde, based on the weight of gelatin, to substantially fully harden the gelatin. However, the aqueous gelatin solution develops pituitousness immediately upon incorporation therein of formaldehyde at levels of about 0.25% by weight or higher. To avoid this problem, formaldehyde can be incorporated in the composition at a level of about 0.20% by weight. This is insufficient to cause pituitousness but sufficient that the dried anticurl layer will not redissolve and mix when the antistatic layer is applied thereover. The balance of the formaldehyde necessary to substantially fully harden the anticurl layer is added to the antistatic coating composition. This is feasible since the antistatic coating composition is not adversely affected by a high level of formaldehyde. After coating of the overlying antistatic layer, the formaldehyde in the antistatic layer diffuses into the anticurl layer to complete the hardening of the gelatin.

As previously indicated, in the preferred embodiment of this invention, the anticurl coating composition is applied prior to the antistatic coating composition. However, in an alternative embodiment of the invention, the antistatic coating composition is applied prior to the anticurl coating composition, that is, the antistatic layer is the lower layer and the anticurl layer is the upper layer. In this embodiment, all of the hardening agent required to harden the hydrophilic colloid in the anticurl layer can, if desired, be provided by diffusion from the antistatic layer. Because the anticurl layer is the upper layer, there is, in this embodiment of the invention, no problem of redissolving of the dried anticurl layer, since no additional layers are coated over it. Accordingly, satisfactory results can be achieved with all of the hardening agent in the antistatic coating composition. It is, of course, not necessary that all of the hardening agent be provided by diffusion from the antistatic layer in this embodiment so that, if desired, part of the hardening agent can be incorporated in the anticurl coating composition and part can be provided by diffusion. This is a matter of choice, with the optimum procedure depending on the particular formulations involved in a particular coating operation. In order to coat the anticurl layer over the antistatic layer, the antistatic agent should be essentially insoluble in the liquid medium of the anticurl coating composition and should be held within the antistatic layer in a well hardened matrix.

There are both advantages and disadvantages to the embodiment of the invention in which the anticurl layer is the upper layer. A disadvantage is that the antistatic protection is generally not quite as good as it is in the case where the antistatic layer is the upper layer. However, the anticurl layer provides protection for the antistatic agent in the underlying antistatic layer, and this is an important advantage. The hygroscopic nature of most antistatic agents renders them very susceptible to abrasion in transport systems, such as are used in the coating, finishing and processing of photographic elements, and this abrasion can result in impaired static protection as well as difficulties in maintaining and cleaning the equipment used in handling the elements.

In all embodiments of the method of this invention, the hardening agent required to harden the hydrophilic colloid of the anticurl layer is provided, at least in part, by diffusion from the antistatic layer. This enables the amount of hardening agent to be kept at a low level in the anticurl coating composition or, in some instances, it enables the anticurl coating composition to be free of hardening agent, as has been previously explained hereinabove. As a result, the problem of "angel hair," which is referred to above, can be effectively avoided. Furthermore, the problem of short "pot life" that exists with anticurl coating compositions containing substantial concentrations of hardening agent is also effectively avoided. Thus, with many hydrophilic colloid compositions containing a substantial concentration of hardening agent, there is a tendency for the viscosity of the composition to increase continuously as a function of time and, at some point, the viscosity will exceed the maximum allowable viscosity for high quality gravure coating. By keeping the concentration of hardening agent at a low level, as is rendered feasible by the method of this invention, the problem of increasing viscosity is avoided. For example, in an aqueous gelatin composition containing formaldehyde at a level of 0.20% by weight, no noticeable increase in viscosity occurs with passage of time, so that the composition has the important advantage of a long "pot life."

In addition to the antistatic agent and the diffusible hardening agent, the antistatic coating composition utilized in the method of this invention can include a variety of addenda. For example, it can include inert particulate materials such as have been described hereinabove, leveling agents, surface tension control agents, viscosity control agents such as hydroxyethyl cellulose or other cellulose ethers, plasticizers such as an acrylic latex, and so forth. Since it is applied by gravure coating, the same considerations as described above with respect to the need for proper control of the formulation of the anticurl coating composition also apply to the antistatic coating composition. Thus, for example, it is advantageous to incorporate isobutyl alcohol or normal butyl alcohol in the antistatic coating composition to reduce surface tension and improve leveling. These can be utilized in similar amounts to those employed in the anticurl coating composition.

Included among the many different types of antistatic agents that are useful in the method of this invention are the following:

(1) inorganic salts such as alkali metal or ammonium halides, e.g. sodium chloride or potassium chloride;

(2) cellulose salts such as alkali metal or ammonium salts of cellulose sulfate;

(3) phosphate salts such as alkali metal or ammonium salts of polyvinyl phosphate;

(4) alkali metal or ammonium salts of alkylaryl polyether sulfonates, e.g., p-[1,1,3,3-tetramethylbutyl]-phenoxyethoxyethyl sodium sulfonate;

(5) salts of naphthalene sulfonic acids such as alkali metal or ammonium salts of 2,5-naphthalene disulfonic acid or of the condensation product of formaldehyde and 2,5-naphthalene disulfonic acid;

(6) salts of polymeric carboxylic acids such as alkali metal or ammonium salts of polyacrylic acid or polymethacrylic acid;

(7) salts of polymeric sulfonic acids such as alkali metal or ammonium salts of polyvinyl sulfonic acid or polystyrene sulfonic acid;

(8) alkali metal or ammonium salts of copolymers of styrene and styrylundecanoic acid; and (9) crosslinked vinylbenzyl quaternary ammonium polymers such as copoly[N-vinylbenzyl-N,N,N-trimethylammonium chloride - co-ethylene glycol dimethacrylate], copoly[N-vinylbenzyl-N,N,N-trimethylammonium chloride- co-ethylene glycol diacrylate], copoly[N-vinylbenzyl-N,N,N-triethylammonium chloride -co-ethylene glycol dimethacrylate] copoly[styrene-co-N-vinylbenzyl-N,N,N-trimethylammonium chloride -co- divinylbenzene].

Since tandem gravure coating is used in the method of this invention, the second coating composition, which, as previously explained, can be either the antistatic coating composition or the anticurl coating composition, is applied within a short time after application of the first coating composition. The exact interval of time between the two coating steps will depend upon the speed of coating, that is, the speed at which the support is advanced, and upon the physical arrangement of the equipment. In general, the duration of this interval is not critical and can be varied as desired. After application of the first layer, it is usually necessary to solidify it, or at least partially solidify it, prior to application of the second layer in order to avoid interlayer mixing. Any suitable method of drying, or other solidification technique such as gelling or setting, can be utilized. For example, the coated support can be passed through a drier of conventional construction in which warm air or other warm gaseous medium is caused to impinge on the coating.

In the method of this invention, two gravure coating stations are arranged in tandem. Each of these stations utilizes a gravure cylinder having an appropriate groove or dot pattern on the surface thereof. The particular type and arrangement of gravure coating equipment utilized in applying the anticurl and antistatic layers in the method of this invention is a matter of choice. For example, both direct gravure coating and offset gravure coating techniques are suitable. Most typically, the anticurl and antistatic layers are first applied to the support and the image-forming layer(s) are applied subsequently. However, this too is a matter of choice, and the anticurl and antistatic layers can be coated subsequent to the coating of the image-forming layer(s), if desired. The photographic element can also be provided with auxiliary layers such as protective overcoat layers, subbing layers, filter layers, and so forth. With photographic elements utilizing polymer-coated paper as the support, the polymer-coating operation can be carried out "in-line" with the tandem gravure coating process of this invention or it can be carried out in a separate "off-line" operation. Generally speaking, it is very advantageous to carry out the tandem gravure process "in-line" with the polymer-coating process, as this provides the most efficient and economical operation.

The type of gravure coating process which provides optimum benefits in the method of this invention is dependent, in part, on the particular coating compositions utilized. For example, in using gelatin as the hydrophilic colloid, hardening agents, such as chrome chloride ($CrCl_3$), that cross-link the carboxyl groups of the gelatin are especially advantageous in that they reduce the degree of reswelling of a dried anticurl layer that takes place when an antistatic coating composition is applied thereover, and this promotes the most efficient use of the antistatic agent. However, if a direct gravure coating method is used with gelatin compositions containing chrome chloride, "angel hair" will occur, even at extremely low levels of addition of chrome chloride. To avoid this problem, a reverse gravure coating method can be utilized. In this process, the gravure cylinder is run faster than the web and in a direction counter to the web direction and the coating composition is transferred, in a very low pressure nip, only from the upper portions of the cells. By limiting transfer to the upper portions of the cells in this manner, the problem of "angel hair" can be effectively avoided.

Figure 1:
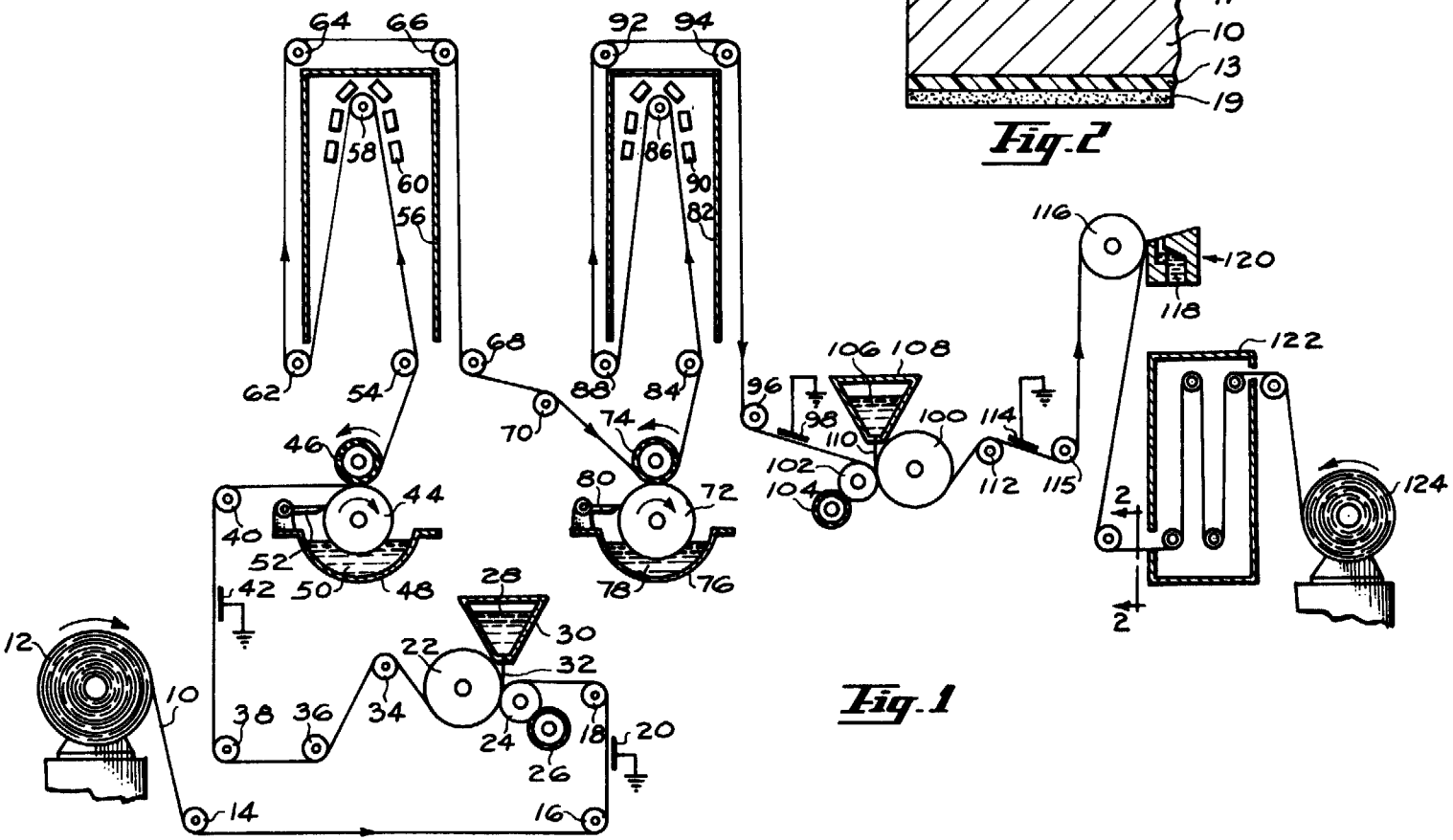
FIG. 1 is a schematic illustration of coating and drying apparatus suitable for carrying out the method of this invention.

In the method of this invention, treatment of the support, prior to application of the anticurl or antistatic coating composition, to enhance bonding of the coating to the support may be necessary, depending on the characteristics of the particular support and coating composition utilized. Such treatment can be carried out in any suitable manner. For example, it can comprise the application of a suitable sub-coating, or a surface treatment which renders the surface of the support receptive to the application of the coated layer. In cases where the surface of the support is a polyethylene layer, a particularly effective procedure is to activate the surface by corona discharge. Methods and apparatus for carrying out corona discharge activation of the surface are described in the prior art, for example, in U.S. Pat. Nos. 3,411,908 and 3,630,742. The overall process may involve several such activation steps. For example, activation of one surface of a paper web prior to the application of a polyethylene layer, activation of the surface of the polyethylene layer prior to application of an anticurl coating composition, activation of the opposite surface of the paper web prior to application of a second polyethylene layer, and activation of the surface of the second polyethylene layer prior to application of a photographic emulsion layer. Preferably, high density polyethylene is used to coat the paper on the side on which the antistatic and anticurl layers are applied and low density or medium density polyethylene is used to coat the paper on the side on which the photographic emulsion layer is applied. Low density polyethylene typically has a density in the range from about 0.90 to about 0.935 grams/cc, while medium density polyethylene is in the range from about 0.935 to about 0.945 and high density polyethylene is in the range from about 0.945 to about 0.975. FIG. 1 illustrates apparatus suitable for carrying out an "in-line" process involving polymer-coating of both sides of a paper support and tandem gravure coating of anticurl and antistatic coating compositions in accordance with this invention. As shown in FIG. 1, photographic paper base 10 is unwound from supply roll 12 and passes around guide rollers 14, 16, and 18 which guide it past corona discharge treatment device 20 (which functions to activate the surface of paper web 10) into a nip formed by chill roll 22 and resilient roll 24. Backing roll 26 engages roll 24 and provides an appropriate degree of pressure in the nip defined by rolls 22 and 24. Molten high-density polyethylene 28 is extruded from extrusion hopper 30 as a falling curtain 32 that is directed into the nip formed by rolls 22 and 24 where it is adhered to paper 10. The polyethylene-coated paper then passes around guide rollers 34, 36, 38, and 40, past corona discharge treatment device 42, into the nip defined by gravure cylinder 44 and resilient backing roll 46. Gravure cylinder 44 rotates within a pan 48 containing an aqueous anticurl coating composition 50, which comprises a hydrophilic colloid and a hardening agent for the hydrophilic colloid. Composition 50 fills the grooves of cylinder 44 and excess composition is removed by doctor blade 52.

As web 10 passes between the nip defined by cylinder 44 and roll 46, it is uniformly coated with a layer of composition 50. The coated web then passes around guide roller 54 and into drier 56 in which it passes over guide roller 58 and is contacted with warm air provided by a series of nozzles 60 at a rate and temperature sufficient to dry the layer of anticurl coating composition. After passing through drier 56, web 10 is directed by guide rollers 62, 64, 66, 68, and 70 into the nip defined by gravure cylinder 72 and resilient backing roll 74. Gravure cylinder 72 rotates within a pan 76 containing an aqueous antistatic coating composition 78, which comprises an antistatic agent and a diffusible hardening agent that is capable of hardening a hydrophilic colloid. Composition 78 fills the grooves of cylinder 72, and excess composition is removed by doctor blade 80. A uniform layer of antistatic composition 78 is applied over the layer of anticurl composition 50 by gravure cylinder 72 and the layer of antistatic composition 78 is dried as web 10 passes through drier 82 in which it is guided by guide rollers 84, 86, and 88 past a series of nozzles 90 which impinge warm air against the web. After leaving drier 82, web 10 is guided by guide rollers 92, 94, and 96 past corona discharge device 98 into a nip formed by chill roll 100 and resilient roll 102. Backing roll 104 engages roll 102 and provides an appropriate degree of pressure in the nip defined by rolls 100 and 102. Molten low-density polyethylene 106 is extruded from extrusion hopper 108 as a falling curtain 110 that is directed into the nip formed by rolls 100 and 102, where it is adhered to paper web 10. After passing around guide roller 112, past corona discharge treatment device 114, and around guide roller 115, web 10 passes around coating roll 116 where a layer of photographic silver halide emulsion 118 is applied by coating hopper 120. In order to dry the layer of emulsion 118, web 10 is passed through drier 122 and, after completion of drying, it is wound on take-up roll 124.

As shown in FIG. 2, the photographic element, prepared by the process illustrated in FIG. 1, is comprised of a paper support 10 having on one side thereof a layer 11 formed from the high-density polyethylene 28 and on the opposite side a layer 13 formed from the low-density polyethylene 106. Overlying polyethylene layer 11 is anticurl layer 15, formed from anticurl coating composition 50, and overlying anticurl layer 15 is antistatic layer 17, formed from antistatic coating composition 78. An image-forming layer 19, formed from silver halide emulsion 118, overlies polyethylene layer 13.

The invention is further illustrated by the following examples of its practice. In these examples, all resistivity measurements were carried out at a relative humidity of 20 percent. Surface resistivity measurements were made by the method for measuring surface resistivity described in U.S. Pat. No. 2,801,191. In the salt bridge measurement, a salt solution was used to contact the edge of a cross-section of a sample of predetermined dimensions. A constant voltage was applied and the current was measured by means of an electrometer or micro-micro-ammeter.

EXAMPLE 1

Coating compositions were prepared as follows:

| Anticurl Composition Component | Parts by Weight |
|---|---|
| Gelatin | 14.920 |
| Amorphous silica* | 2.080 |
| Formaldehyde | 0.025 |
| Isobutanol | 9.600 |
| Water | 73.375 |
| | 100.000 |

*Particle size of approximately 4 microns

| Antistatic Composition Component | Parts by Weight |
|---|---|
| Sodium cellulose sulfate | 8.00 |
| Formaldehyde | 0.24 |
| Isobutanol | 8.00 |
| Water | 83.76 |
| | 100.00 |

A photographic support, composed of paper coated on each side with polyethylene, was provided with anticurl and antistatic layers formed from the compositions described above, with the anticurl composition being applied at a first gravure coating station and the antistatic composition at a second gravure coating station arranged in tandem with the first one. At each coating station, the coating composition was applied by a direct gravure process. The anticurl composition was applied with a 60 line/centimeter triangular helix roll with 0.0047 centimeter cell depth. The antistatic coating composition was applied with a 80 line/centimeter triangular helix roll with 0.0036 centimeter cell depth. Excellent results were obtained using coating speeds in the range of 200 to 300 centimeters per second, with the viscosity of the anticurl composition being in the range of 100 to 150 centipoises, the dry coverage of the anticurl layer being in the range of 2 to 2.5 grams per square meter, the viscosity of the antistatic composition being in the range of 30 to 50 centipoises, and the thickness of the antistatic layer being sufficient to provide 0.6 to 0.8 grams of sodium cellulose sulfate per square meter. In all instances, the resulting photographic element was effectively protected against static and exhibited little or no tendency to undergo curling.

EXAMPLE 2

Coating composition were prepared as follows:

| Anticurl Composition Component | Parts by Weight |
|---|---|
| Gelatin | 14.920 |
| Amorphous silica* | 2.080 |
| Formaldehyde | 0.025 |
| N-butanol | 6.000 |
| Water | 76.975 |
| | 100.000 |

*Particle size of approximately 4 microns

| Antistatic Composition Component | Parts by Weight |
|---|---|
| *Antistatic agent | 5.50 |
| Gelatin | 0.95 |
| Acrylic latex | 0.82 |
| Hydroxyethyl cellulose | 0.10 |
| Formaldehyde | 0.44 |
| Isobutanol | 8.00 |
| Water | 84.19 |
| | 100.00 |

*Copoly[N-vinylbenzyl-N,N,N-trimethylammonium chloride - co -ethylene glycol dimethacrylate]

The same photographic support as was employed in Example 1 was coated with the compositions described above in the same manner using the same equipment. The resulting product had excellent antistatic and anticurl protection.

To demonstrate the effectiveness of the method of this invention in efficiently utilizing the antistatic agent, anticurl and antistatic layers were formed from the compositions described above, using in one case the tandem gravure coating method described herein and in the other case dual slide hopper coating as described in U.S. Pat. No. 2,761,791. Coatings were made by each method for a range of coverages of the antistatic agent, and surface resistivity measurements were made for each level of antistatic agent. The results obtained were as follows:

| Dual Slide Hopper | | Tandem Gravure | |
|---|---|---|---|
| Coverage mg/m$^2$ | Surface Resistivity Log ohms/sq. | Coverage mg/m$^2$ | Surface Resistivity Log ohms/sq. |
| 200 | 12.4 | 200 | 10.5 |
| 300 | 12.0 | 300 | 10.1 |
| 400 | 11.6 | 400 | 9.8 |
| 500 | 11.4 | 500 | 9.5 |
| 600 | 10.6 | 600 | 9.2 |
| 700 | 10.4 | 700 | 9.0 |
| 800 | 10.2 | 800 | 8.9 |
| 900 | 9.8 | 900 | 8.6 |
| 1000 | 9.6 | 1000 | 8.5 |

As can be readily seen from these data, by use of the method of this invention, equivalent antistatic protection can be obtained at much lower levels of antistatic agent coverage; for example, a resistivity of 9.8 requires 900 milligrams per square meter of antistatic agent using dual slide hopper coating, but only 400 milligrams per square meter using the method of this invention.

EXAMPLE 3

Coating compositions were prepared as follows:

| Anticurl Composition Component | Parts by Weight |
|---|---|
| Gelatin | 14.920 |
| Amorphous silica* | 2.080 |
| Formaldehyde | 0.010 |
| Chrome chloride | 0.015 |
| Water | 82.975 |
| | 100.000 |

*Particle size of approximately 4 microns

| Antistatic Composition Component | Parts by Weight |
|---|---|
| Antistatic agent* | 5.50 |
| Gelatin | 0.95 |
| Acrylic latex | 0.82 |
| Formaldehyde | 0.44 |
| Water | 92.29 |
| | 100.00 |

*Copoly(N-vinylbenzyl-N,N,N-trimethylammonium chloride - co - ethylene glycol dimethacrylate)

The same photographic support as was employed in Example 2 was coated with the compositions described above using a tandem gravure coating process in which reverse gravure coating was employed at each coating station. Coatings were made for a range of different coverages of antistatic agent, and surface resistivity measurements were made for each level of antistatic agent. The results obtained were as follows:

| Coverage ($mg/m^2$) | Surface Resistivity (Log ohms/sq.) |
|---|---|
| 50 | 12.2 |
| 100 | 10.5 |
| 150 | 10.0 |
| 200 | 9.8 |
| 400 | 9.1 |

Comparing these data with those of Example 2, it is apparent that improved antistatic protection was obtained. For example, a resistivity of 9.8 required 400 milligrams per square meter of antistatic agent in the tandem gravure process of Example 2, but only 200 milligrams per square meter in this example. This improvement in results is attributable to the use of chrome chloride in the anticurl composition. The chrome chloride is particularly effective in avoiding reswelling of the dried anticurl layer when the antistatic coating is applied thereover. Less reswell means less imbibition of the antistatic composition into the anticurl layer and, accordingly, more efficient use of the antistatic agent.

EXAMPLE 4

The coating compositions of Example 2 were coated on the same photographic support as employed in Example 2, but the order in which the coatings were applied was reversed; i.e., the antistatic composition was applied at the first coating station and the anticurl composition was applied at the second coating station so that the anticurl layer was applied over top of the antistatic layer. Coatings were made for a range of different coverages of antistatic agent. In each case, surface resistivity was measured after coating of the antistatic layer, and again after coating of the anticurl layer. Resistivity was also measured by the salt bridge method after coating of the anticurl layer. The results obtained were as follows:

| Coverage ($mg/m^2$) | Surface Resistivity After Antistatic Coating (Log ohms/sq.) | Surface Resistivity After Anticurl Coating (Log ohms/sq.) | Salt Bridge (Log ohms/sq.) |
|---|---|---|---|
| 200 | 9.3 | 10.9 | 9.2 |
| 400 | 8.8 | 10.6 | 8.9 |
| 600 | 8.6 | 10.2 | 8.6 |

As shown by the above data, application of the anticurl coating composition over top of the antistatic layer results in little, if any, loss in antistatic protection. While the resistivity appears to be higher when surface resistivity measurements are made, using the more truly representative technique of salt bridge measurements shows that no significant change in resistivity occurred.

Salt bridge measurements were also made for the product of Example 2 in which the antistatic layer was coated over the anticurl layer. Results obtained were as follows:

| Coverage ($mg/m^2$) | Surface Resistivity (Log ohms/sq.) | Salt Bridge (Log ohms/sq.) |
|---|---|---|
| 200 | 10.5 | 10.5 |
| 400 | 9.8 | 9.9 |
| 600 | 9.2 | 9.1 |

Tandem gravure coating of the anticurl and antistatic coating compositions described herein provides many important benefits in the manufacture of photographic elements. For example, as compared with the use of a single layer which serves to provide both anticurl and antistatic protection, it much more efficiently utilizes the hydrophilic colloid which counteracts curling and the antistatic agent which dissipates the static charge, since it avoids interactions between these materials which interfere with their proper functioning. Also, as compared with the use of simultaneous dual layer coating techniques to apply separate anticurl and antistatic layers, it much more efficiently utilizes the hydrophilic colloid and the antistatic agent, since it avoids interlayer mixing. The types of compositions utilized to form anticurl and antistatic layers are particularly prone to undergo interlayer mixing in simultaneous dual layer coating, so this presents a very serious problem. Antistatic agent which ends up in the anticurl layer as a result of interlayer mixing is, of course, not effective in providing the desired conducting surface. Since antistatic agents are typically an important cost factor in the manufacture of photographic elements, avoidance of interlayer mixing by the method of this invention is highly beneficial.

The tandem gravure process described herein is also advantageous in that it effectively avoids problems that can be encountered in providing good bonding between separate anticurl and antistatic layers. Thus, for example, if an anticurl layer is coated and dried and the element is stored for a considerable period of time, such as several days or more, before the antistatic layer is applied, poor adhesion between the antistatic and anticurl layers can result, apparently as a result of changes in the character of the surface of the anticurl layer that occur on aging. With the tandem gravure process described herein, there is no opportunity for such undesirable changes in surface characteristics to occur. Furthermore, the tandem gravure coating process described herein is highly effective in providing the desired smooth layers with uniform thickness and proper coverage, and is capable of being carried out at very high coating speeds.

The invention has been described in detail with particular reference to preferred embodiments thereof, but it will be understood that variations and modifications can be effected within the spirit and scope of the invention.

I claim:

1. In a method for the manufacture of a photographic element comprising a support coated on one side with at least one image-forming layer and on the opposite side with separate contiguous anticurl and antistatic layers, the improvement wherein said anticurl and antistatic layers are coated on said support by a tandem gravure coating process in which said anticurl layer is formed by gravure coating of an anticurl coating composition comprising a hydrophilic colloid, said antistatic layer is formed by gravure coating of an antistatic coating composition comprising an antistatic agent and a diffusible hardening agent that is capable of acting as a hardener for the hydrophilic colloid in said anticurl layer, and said diffusible hardening agent diffuses from said antistatic layer into said anticurl layer to harden said hydrophilic colloid.

2. In a method for the manufacture of a photographic element comprising a support coated on one side with at least one image-forming layer and on the opposite side with an anticurl layer overlying said support and an antistatic layer overlying said anticurl layer, the improvement wherein said anticurl and antistatic layers are coated on said support by a tandem gravure coating process in which said anticurl layer is formed by gravure coating of an anticurl coating composition comprising a hydrophilic colloid and a hardening agent which acts as a hardener for said hydrophilic colloid, said hardening agent being present in said anticurl coating composition in an amount insufficient to effectively harden the hydrophilic colloid present therein, and said antistatic layer is formed by gravure coating of an antistatic coating composition comprising an antistatic agent and a diffusible hardening agent that is capable of acting as a hardener for the hydrophilic colloid in said anticurl layer, said diffusible hardening agent being present in said antistatic coating composition in an amount sufficient to diffuse from said antistatic layer into said anticurl layer to complete the hardening of the hydrophilic colloid present in said anticurl layer.

3. In a method for the manufacture of a photographic element comprising a support coated on one side with at least one image-forming layer and on the opposite side with an antistatic layer overlying said support and an anticurl layer overlying said antistatic layer, the improvement wherein said anticurl and antistatic layers are coated on said support by a tandem gravure coating process in which said anticurl layer is formed by gravure coating of an anticurl coating composition comprising a hydrophilic colloid and said antistatic layer is formed by gravure coating of an antistatic coating composition comprising an antistatic agent and a diffusible hardening agent that is capable of acting as a hardener for the hydrophilic colloid in said anticurl layer, said diffusible hardening agent being present in said antistatic coating composition in an amount sufficient to diffuse from said antistatic layer into said anticurl layer to provide all or part of the total amount of hardening agent needed to effectively harden the hydrophilic colloid present in said anticurl layer.

4. A method as claimed in claim 1 wherein said element is a radiation-sensitive element having at least one image-forming layer comprising a radiation-sensitive agent dispersed in a hydrophilic colloid.

5. A method as claimed in claim 1 wherein said element is a receiver sheet having an image-forming layer comprising a nucleating agent dispersed in a hydrophilic colloid.

6. A method as claimed in claim 1 wherein said support is paper coated on each side with a polymer layer.

7. A method as claimed in claim 1 wherein said support is paper coated on each side with a polyethylene layer.

8. A method as claimed in claim 1 wherein said support is a polymeric film base.

9. A method as claimed in claim 1 wherein each said image-forming layer comprises a silver halide dispersed in gelatin.

10. A method as claimed in claim 1 wherein said hydrophilic colloid in said anticurl coating composition is gelatin.

11. A method as claimed in claim 1 wherein said diffusible hardening agent is formaldehyde.

12. A method as claimed in claim 1 wherein said antistatic agent is sodium cellulose sulfate.

13. A method as claimed in claim 1 wherein said antistatic agent is copoly{N-vinylbenzyl-N,N,N-trimethylammonium chloride—co—ethylene glycol dimethacrylate}.

14. A method as claimed in claim 2 wherein each of said anticurl coating composition and said antistatic coating composition contains formaldehyde.

15. A method as claimed in claim 2 wherein each of said anticurl coating composition and said antistatic coating composition contains isobutanol or normal butanol.

16. In a method for the manufacture of a photographic element in which a support is coated on one side with at least one image-forming layer comprising a gelatin silver halide emulsion and on the opposite side with separate contiguous anticurl and antistatic layers, the improvement wherein said anticurl and antistatic layers are coated on said support by a tandem gravure coating process in which said anticurl layer is formed by gravure coating of an aqueous anticurl coating composition comprising gelatin and a gelatin-hardening agent, said gelatin-hardening agent being present in said anticurl coating composition in an amount insufficient to effectively harden the gelatin present therein, and said antistatic layer is formed by gravure coating of an aqueous antistatic coating composition comprising an antistatic agent and a diffusible gelatin-hardening agent, said diffusible gelatin-hardening agent being present in said antistatic coating composition in an amount sufficient to diffuse from said antistatic layer into said anticurl layer to complete the hardening of the gelatin present in said anticurl layer.

17. In a method for the manufacture of a photographic element in which a support comprised of polyethylene-coated paper is coated on one side with at least one image-forming layer comprising a gelatin silver halide emulsion and on the opposite side with separate contiguous anticurl and antistatic layers, the improvement wherein said anticurl and antistatic layers are coated on said support by a tandem gravure coating process in which said anticurl layer is formed by gravure coating of an aqueous anticurl coating composition comprising gelatin, silica, formaldehyde and isobutanol, said formaldehyde being present in said anticurl coating composition in an amount insufficient to effectively harden the gelatin present therein, and said antistatic layer is formed by gravure coating of an aqueous antistatic coating composition comprising sodium cellulose sulfate, formaldehyde and isobutanol, said formaldehyde being present in said antistatic coating composition in an amount sufficient to diffuse from said antistatic layer into said anticurl layer to complete the hardening of the gelatin present in said anticurl layer.

18. A method for the manufacture of a photographic element comprising the step of coating a support with separate contiguous anticurl and antistatic layers by a tandem gravure coating process in which said anticurl layer is formed by gravure coating of an anticurl coating composition comprising a hydrophilic colloid and a hardening agent which acts as a hardener for said hydrophilic colloid, said hardening agent being present in said anticurl coating composition in an amount insufficient to effectively harden the hydrophilic colloid present therein, and said antistatic layer is formed by gravure coating of an antistatic coating composition comprising an antistatic agent and a diffusible hardening agent that is capable of acting as a hardener for the hydrophilic colloid in said anticurl layer, said diffusible hardening agent being present in said antistatic coating composition in an amount sufficient to diffuse from said antistatic layer into said anticurl layer to complete the hardening of the hydrophilic colloid present in said anticurl layer.

19. A method for the manufacture of a photographic element comprising the steps of (1) coating one side of a support with separate contiguous anticurl and antistatic layers by a tandem gravure coating process in which said anticurl layer is formed by gravure coating of an anticurl coating composition comprising a hydrophilic colloid and a hardening agent which acts as a hardener for said hydrophilic colloid, said hardening agent being present in said anticurl coating composition in an amount insufficient to effectively harden the hydrophilic colloid present therein, and said antistatic layer is formed by gravure coating of an antistatic coating composition comprising an antistatic agent and a diffusible hardening agent that is capable of acting as a hardener for the hydrophilic colloid in said anticurl layer, said diffusible hardening agent being present in said antistatic coating composition in an amount sufficient to diffuse from said antistatic layer into said anticurl layer to complete the hardening of the hydrophilic colloid present in said anticurl layer, and (2) coating the opposite side of said support with at least one image-forming layer comprising a radiation-sensitive agent dispersed in a hydrophilic colloid.

20. A method for the manufacture of a photographic element comprising a paper support, said method comprising the steps of (1) applying to one side of a web of said paper a first polymeric layer, (2) coating an anticurl layer overlying said first polymeric layer, (3) coating an antistatic layer overlying said anticurl layer, (4) applying to the opposite side of said web a second polymeric layer, and (5) coating over said second polymeric layer at least one image-forming layer comprising a radiation-sensitive agent dispersed in a hydrophilic colloid; said anticurl and antistatic layers being coated by a tandem gravure coating process in which said anticurl layer is formed by gravure coating of an anticurl coating composition comprising a hydrophilic colloid and a hardening agent which acts as a hardener for said hydrophilic colloid, said hardening agent being present in said anticurl coating composition in an amount insufficient to effectively harden the hydrophilic colloid present therein, and said antistatic layer is formed by gravure coating of an antistatic coating composition comprising an antistatic agent and a diffusible hardening agent that is capable of acting as a hardener for the hydrophilic colloid in said anticurl layer, said diffusible hardening agent being present in said antistatic coating composition in an amount sufficient to diffuse from said antistatic layer into said anticurl layer to complete the hardening of the hydrophilic colloid present in said anticurl layer.

21. A method for the manufacture of a photographic element comprising a paper support, said method comprising the steps of (1) applying to one side of a web of said paper a first polymeric layer, (2) coating an antistatic layer overlying said first polymeric layer, (3) coating an anticurl layer overlying said antistatic layer, (4) applying to the opposite side of said web a second polymeric layer, and (5) coating over said second polymeric layer at least one image-forming layer comprising a radiation-sensitive agent dispersed in a hydrophilic colloid; said anticurl and antistatic layers being coated by a tandem gravure coating process in which said anticurl layer is formed by gravure coating of an anticurl coating composition comprising a hydrophilic colloid, and said antistatic layer is formed by gravure coating of an antistatic coating composition comprising an antistatic agent and a diffusible hardening agent that is capable of acting as a hardener for the hydrophilic colloid in said anticurl layer, said diffusible hardening agent being present in said antistatic coating composition in an amount sufficient to diffuse from said antistatic layer into said anticurl layer to provide all or part of the total amount of hardening agent needed to effectively harden the hydrophilic colloid present in said anticurl layer.

22. A method as claimed in claim 20 wherein said tandem gravure coating process is carried out inline with said application of said first and second polymeric layers.

23. A method as claimed in claim 20 wherein said first polymeric layer is comprised of high density polyethylene, said second polymeric layer is comprised of low density polyethylene, each said image-forming layer comprises a gelatin silver halide emulsion, said anticurl coating composition comprises gelatin and a gelatin-hardening agent, and said antistatic coating composition comprises an antistatic agent and a gelatin-hardening agent.

24. A method as claimed in claim 20 wherein said first polymeric layer is comprised of high density polyethylene, said second polymeric layer is comprised of low density polyethylene, each said image-forming layer comprises a gelatin silver halide emulsion, said anticurl coating composition comprises gelatin, silica, formaldehyde and isobutanol, and said antistatic coating composition comprises sodium cellulose sulfate, formaldehyde and isobutanol.

25. A photographic element comprising a support having on one side thereof at least one image-forming layer and having on the opposite side thereof separate contiguous anticurl and antistatic layers, said anticurl and antistatic layers having been coated on said support by a tandem gravure coating process in which said anticurl layer is formed by gravure coating of an anticurl coating composition comprising a hydrophilic colloid and said antistatic layer is formed by gravure coating of an antistatic coating composition comprising an antistatic agent and a diffusible hardening agent that is capable of acting as a hardener for the hydrophilic colloid in said anticurl layer, said anticurl layer having been at least partially hardened by diffusible hardening agent which has diffused from said antistatic layer.

26. A photographic element comprising a support having on one side thereof at least one image-forming layer comprising a radiation-sensitive agent dispersed in a hydrophilic colloid and having on the opposite side thereof separate contiguous anticurl and antistatic layers, said antistatic layer overlying said anticurl layer, said anticurl and antistatic layers having been coated on said support by a tandem gravure coating process in which said anticurl layer is formed by gravure coating of an anticurl coating composition comprising a hydrophilic colloid and a hardening agent which acts as a hardener for said hydrophilic colloid, said hardening agent being present in said anticurl coating composition in an amount insufficient to effectively harden the hydrophilic colloid present therein, and said antistatic layer is formed by gravure coating of an antistatic coating composition comprising an antistatic agent and a diffusible hardening agent that is capable of acting as a hardener for the hydrophilic colloid in said anticurl layer, said diffusible hardening agent being present in said antistatic coating composition in an amount sufficient to diffuse from said antistatic layer into said anticurl layer to complete the hardening of the hydrophilic colloid present in said anticurl layer.

27. A photographic element comprising a support having on one side thereof at least one image-forming layer comprising a radiation-sensitive agent dispersed in a hydrophilic colloid and having on the opposite side thereof separate contiguous anticurl and antistatic layers, said anticurl layer overlying said antistatic layer, said anticurl and antistatic layers having been coated on said support by a tandem gravure coating process in which said anticurl layer is formed by gravure coating of an anticurl coating composition comprising a hydrophilic colloid, and said antistatic layer is formed by gravure coating of an antistatic coating composition comprising an antistatic agent and a diffusible hardening agent that is capable of acting as a hardener for the hydrophilic colloid in said anticurl layer, said diffusible hardening agent being present in said antistatic coating composition in an amount sufficient to diffuse from said antistatic layer into said anticurl layer to provide all or part of the total amount of hardening agent needed to effectively harden the hydrophilic colloid present in said anticurl layer.

28. A photographic element as claimed in claim 25 wherein each said image-forming layer is a gelatin silver halide emulsion layer and said hydrophilic colloid in said anticurl coating composition is gelatin.

29. A photographic element as claimed in claim 26 wherein said support is paper coated on each side with a polyethylene layer, each said image-forming layer is a gelatin silver halide emulsion layer, said anticurl coating composition comprises gelatin and formaldehyde and said antistatic coating composition comprises sodium cellulose sulfate and formaldehyde.

30. A photographic element as claimed in claim 26 wherein said support is paper coated on each side with a polyethylene layer, each said image-forming layer is a gelatin silver halide emulsion layer, said anticurl coating composition comprises gelatin, silica, formaldehyde and isobutanol, and said antistatic coating composition comprises sodium cellulose sulfate, formaldehyde and isobutanol.

31. A photographic element as claimed in claim 26 wherein said support is paper coated on each side with a polyethylene layer, each said image-forming layer is a gelatin silver halide emulsion layer, said anticurl coating composition comprises gelatin, silica, formaldehyde and normal butanol and said antistatic coating composition comprises formaldehyde and copoly{N-vinylbenzyl-N,N,N-trimethylammonium chloride-co-ethylene glycol dimethacrylate}.

32. A photographic element as claimed in claim 26 wherein said support is paper coated on each side with a polyethylene layer, each said image-forming layer is a gelatin silver halide emulsion layer, said anticurl coating composition comprises gelatin, silica, formaldehyde and chrome chloride, and said antistatic coating composition comprises formaldehyde and copoly{N-vinylbenzyl-N,N,N-trimethylammonium chloride-co-ethylene glycol dimethacrylate}.

* * * * *